US008746020B2

(12) United States Patent
Anderson

(10) Patent No.: US 8,746,020 B2
(45) Date of Patent: Jun. 10, 2014

(54) PORTABLE EQUIPMENT SECURITY DEVICE

(76) Inventor: Scott R. Anderson, Dracut, MA (US)

( * ) Notice: Subject to any disclaimer, the term of this patent is extended or adjusted under 35 U.S.C. 154(b) by 1590 days.

(21) Appl. No.: 11/650,178

(22) Filed: Jan. 5, 2007

(65) Prior Publication Data

US 2008/0163653 A1 Jul. 10, 2008

(51) Int. Cl.
*E05B 69/00* (2006.01)
*E05B 73/00* (2006.01)

(52) U.S. Cl.
USPC ..... 70/58; 70/14; 361/679

(58) Field of Classification Search
None
See application file for complete search history.

(56) References Cited

U.S. PATENT DOCUMENTS 3,423,968 A * 1/1969 Foote ..... 70/14
4,004,440 A * 1/1977 Dreyer ..... 70/15
4,924,683 A * 5/1990 Derman ..... 70/14
5,832,754 A * 11/1998 McKenzie ..... 70/58
6,257,029 B1 * 7/2001 Liao ..... 70/58
6,308,540 B1 * 10/2001 Lee ..... 70/58
6,401,205 B1 * 6/2002 Rallis et al. ..... 713/172
6,662,602 B1 * 12/2003 Carl ..... 70/58

* cited by examiner

*Primary Examiner* — Mark Williams
(74) *Attorney, Agent, or Firm* — Lambert & Associates; Gary E. Lambert; David J. Connaughton, Jr.

(57) ABSTRACT

A locking cable device, which generally inhibits the theft of portable and more specifically inhibits the theft of expensive, electronic devices such as computers, laptops, and projectors. The security device works by use of a hook that hooks through an opening in an outside wall of the equipment to be secured. The hole can be an existing hole in the outside wall of the equipment, either round, square, or rectangular, such as a vent slot or security slot. A user may also add the opening by merely drilling an aperture or slot, sized appropriately for the corresponding hook on the security device. The hooked position is maintained by use of a housing locked on to the cable, close enough to the equipment being secured that the hook cannot be moved to an angle necessary for removal.

19 Claims, 11 Drawing Sheets

FIG. 2
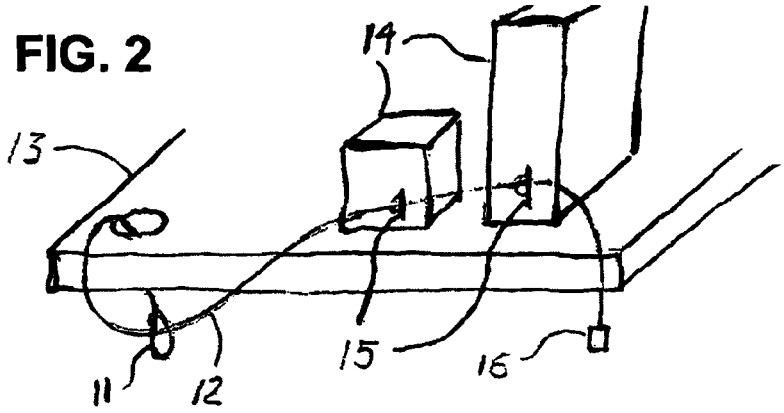
FIG. 3
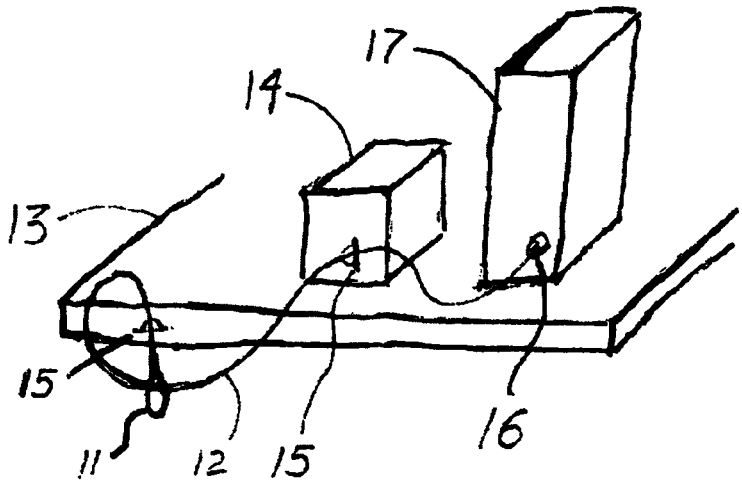
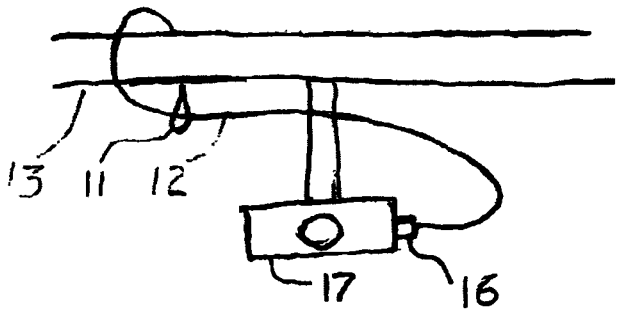
FIG. 4

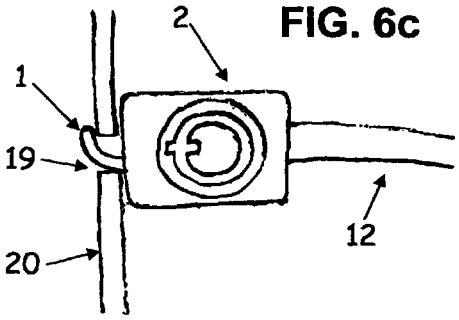
FIG. 6c
FIG. 7
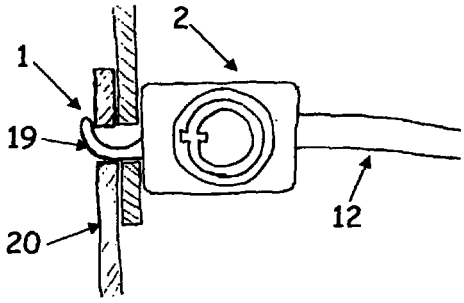

PORTABLE EQUIPMENT SECURITY DEVICE

FIELD OF INVENTION

The present invention relates generally to security systems and in particular security systems for portable equipment, specifically expensive portable equipment such as computers.

BACKGROUND OF THE INVENTION

The present invention relates to anti-theft devices for deterring the theft of small but expensive pieces of equipment. Many devices have been developed to help prevent the theft of computers and other electronic equipment. Since many systems that need security include several items, such as a computer and a monitor and a printer, such security devices often utilize a cable which connects each of the components to each other and/or to a relatively immovable object such as a desk.

Most computer manufacturers incorporate some attachment method for security devices. This practice began on some of the earliest Macintosh computer models, where they provided several different sized security slots designed to accept 'snap-in' security attachments that would then allow a security cable to pass through that attachment. Other manufacturers provided reversible brackets built into the computer chassis that allowed you to remove the computer cover and turn the bracket around for use with a security cable. Even others had nothing but regular chassis screws that were secured by use of "screw-on" fasteners that security cables passed through to prevent unscrewing the fastener and thus secure the equipment. All this has evolved over the years to the point where most manufacturers of desktop computers provide a bracket already protruding from the back of the chassis with a hole that a security cable can pass through.

On smaller devices like laptops where a protruding bracket is undesirable, manufacturers have adopted a small security slot in the exterior wall. Many different security devices have been developed over the years to fit into this security slot. The majority of those devices rely on two or more tiny opposing hooks to maintain a locked position in the security slot, or one slot engagement member with one or two pins also entering the slot to maintain the locked position of the slot engagement member, the pins preventing rotation of the entire housing to prevent moving the slot engagement member to align with the slot and pull back out of the security slot.

One of the biggest drawbacks of the existing devices is that all the laptop manufacturers design this security slot in vastly different sizes and the wall through which the hole, opening aperture or slot passes is made of a wide range of thicknesses. The existing security devices must be designed to fit the thickest of these walls, and thus they "flop around loosely" on most laptops. This creates a perception of insecurity that has plagued the industry since its inception. The present inventor has been in the industry for almost 15 years and dealt with many different laptop security devices and has had to deal with this major complaint from customers ever since computer manufacturers started putting existing slots into the computers.

The second major drawback of existing devices for laptop security is that previous thinking has limited the inventions to a slot engagement member providing security and a second engagement member or pin entering the security slot to maintain the locked position. This cuts down the raw physical size of the engagement member to a fraction of the size of the available security slot, making the device much easier to break, or snap off, at the point of security. The present inventor has seen customer tests of existing products that work with the small security slot in laptops fail by breaking year after year.

Overriding the considerations of laptop security are computer security needs in general. For many years, there have been countless security devices for computers that were model-specific, such as special sized enclosures or straps, or cables with special fasteners for the exact computer they were meant to protect. Many times the user did not realize that the security device they purchased would not work on other computers until they replaced the computer with the next model. With today's constant upgrades, this type of security device is simply inefficient and costly.

SUMMARY OF THE INVENTION

The present invention provides a cable lock that addresses all of the above weaknesses of cable locks currently provided for computer and electronic equipment, while also providing a cable lock for use in other industries because of its universal nature. It addresses the major problem of perceived insecurity of the loose, floppy cable locks by ratcheting tightly against the equipment to be secured and is perceived as a "solid" security measure. The present invention also overcomes the weaknesses of previous designs that required multiple hooks or pins to maintain a locked position in existing laptop security slots by providing for a hook that is the full peripheral dimension of the hole that it passes through, maximizing the level of security. The present invention also addresses the problem of existing locking cables in the market that fit into existing security slots on laptops, but the locking mechanism is permanently attached to the end of the cable and cannot be removed to allow the cable to thread through fasteners on multiple pieces of equipment. The present invention is the first truly universal security device that is intended to work on any technology device, whether it has a security slot or not. It doubles as a laptop security cable or a desktop security cable, adapting as the user updates their equipment.

The basic design of the hook requires the hook to be taller than it is wide, so that entry into a round hole with a diameter greater than the width of the hook can occur, and when the hook is then moved to an angle more perpendicular to the external wall of the equipment, it cannot be removed from the round hole when the hook is at that angle as long as the diameter of the hole is less than the height of the hook. Thus the diameter of any round hole must be greater than the width of the hook and less than the height of the hook. It is foreseen that a standard hook size will be sold with instructions to drill a standard hole size to work with that hook. However, it is expected that as equipment is recognized as having built-in holes that do not work with standard hooks, cables with different sized hooks will be sold. It is also expected that future cables will have a replaceable or adjustable hook design to fit any size hole.

Another major improvement over existing devices is the ability of the present invention to secure multiple pieces of equipment with one lock. The housing of the cable lock is intended to be removed, allowing the cable to pass through multiple pieces of equipment or security fasteners (common when securing desktop computers). The housing can then be replaced on the cable to be secured independently (as a standard desktop cable lock is secured), or to fit into a vent slot, drilled hole, or security slot as might be required for laptop security or flat screen monitors.

The following drawings are for the purpose of illustration only and are not intended to define the limits of the invention.

BRIEF DESCRIPTION OF THE DRAWINGS

Advantages of the present invention will be apparent from the following detailed description of exemplary embodiments thereof, which description should be considered in conjunction with the accompanying drawings, in which:

FIG. 2 is a perspective view of a first embodiment of the present invention attached to another object such as a desk by way of a loop on one end of the cable. The invention is shown in one of its "multiple-use" configurations having passed through holes on security fasteners (built-in or add-on brackets) on one or more pieces of equipment, with the housing assembly of FIG. 1 locked onto the end of the cable without the hook being used to secure a final piece of equipment.

FIG. 3 is a perspective view similar to FIG. 2 but the invention is shown in a second of its "multiple-use" configurations having passed through holes on security fasteners (built-in or add-on brackets) on one or more pieces of equipment, with the last piece of equipment being secured by use of the hook hooking into a slot or hole (either built-in or added-on) as shown in FIG. 8.

FIG. 4 is a perspective view similar to FIG. 2 but the invention is shown in a third of its "multiple-use" configurations having been secured on its loop end to a another object (in this case a ceiling beam) and only used to secure a single piece of equipment (in this case an overhead projector) by use of the hook hooking into a slot or hole (either built-in or added-on) as shown in FIG. 8.

FIG. 6C is a side view of the hook in the position of the first angle of FIG. 6B with the housing of the first embodiment moved into a position that prevents movement of the hook back to the second angle, thus preventing removal of the hook from the exterior wall.

FIG. 7 is similar to FIG. 6C except that it shows the method of FIG. 5 of keeping a cover closed by hooking the hook through aligned apertures in the walls of the cover and the case.

FIG. 11A is a perspective view of a second preferred embodiment of the present invention, while

DESCRIPTION OF THE PREFERRED EMBODIMENTS

Figure 1:
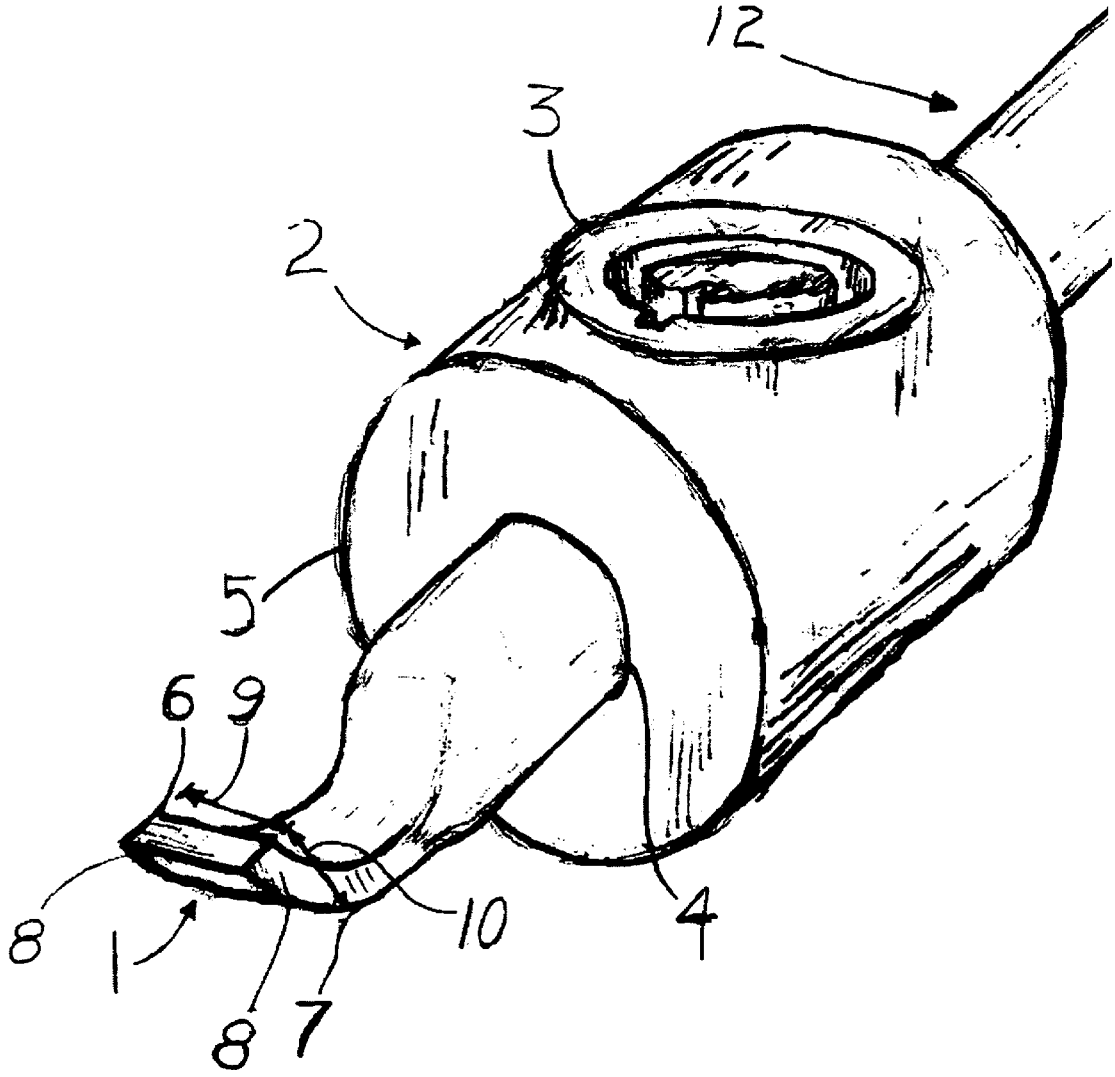
FIG. 1 is a perspective view of a first embodiment of the present invention of the housing assembly clamped onto the cable.
Figure 5:
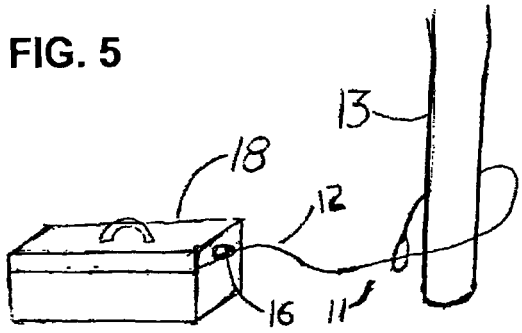
FIG. 5 is a perspective view similar to FIG. 2 but the invention is shown in a fourth of its "multiple-use" configurations having been secured on its loop end to a another object (in this case a pole) and only used to secure a single piece of equipment (in this case a toolbox) but also being used to keep that equipment closed (see FIG. 7) by use of the hook hooking through two aligned holes (either built-in or added-on), one hole in the cover, and one in the main case.

The object of the present invention is a method of attaching a cable 12 to a hole or slot 19 in an external wall 20 (FIG. 6) of the portable equipment to be secured by hooking the hook 1 at the distal end of the cable 12 into that hole or slot 19 and maintaining the hooked position by locking a housing assembly 2 onto the cable 12, close enough to the external wall 20 to prevent unhooking the hook 1. The housing assembly 2 is locked or unlocked from the cable 12 by use of a locking mechanism 3, in this illustration a keyed lock cylinder. The illustrated housing assembly 2 has a lengthwise hole 4 through which the cable 12 can be passed.

The preferred design of the present invention relies on the height 10 of the hook 1 from the top 6 to the bottom 7 being greater than the width 9 between the sides 8. This allows the present invention to be secured into any hole 19 that has a round diameter less than the hook's height 10 and greater than the hook's width 9. It also allows the present invention to be secured into any hole 19 into which it fits that has a square or rectangular shape where its short side is shorter than the hook's height 10. Thus the invention can work with any existing hole or slot 19 in and external wall 20, such as vent holes or security holes, whether those holes 19 are round, square, or rectangular, or one can be drilled if none exist.

Thus very few, or even one, standard sized hooks 1 can fit a very wide range of built-in or added-on holes 19 in exterior walls 20. It is also envisioned that replaceable or 'height adjustable' hooks 1 will be added to the product as it is called for.

One major improvement of the invention over existing cable locks, especially for use in the technology industry, is that it works in multiple configurations as the user's needs change with rapid changes in technology. Several of these configurations are shown in FIGS. 2, 3, 4 and 5. It can be used to secure single or multiple pieces of equipment, whether the pieces of equipment 14 have built-in or add-on security fasteners 15, or whether the pieces of equipment 14 have built-in or add-on holes or slots 19 that the hook 1 can attach to.

Figure 12:
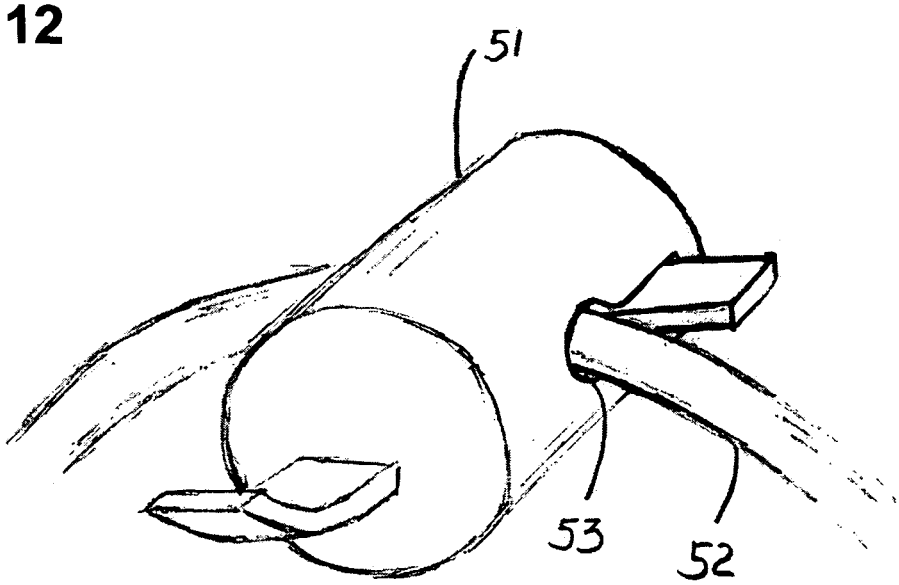
FIG. 12 is a perspective view of a security fastener, that works similar to FIG. 11, but uses a security cable or padlock shackle passed transversely through the housing to maintain or release the hook retraction instead of an integrated locking mechanism.
Figure 13:
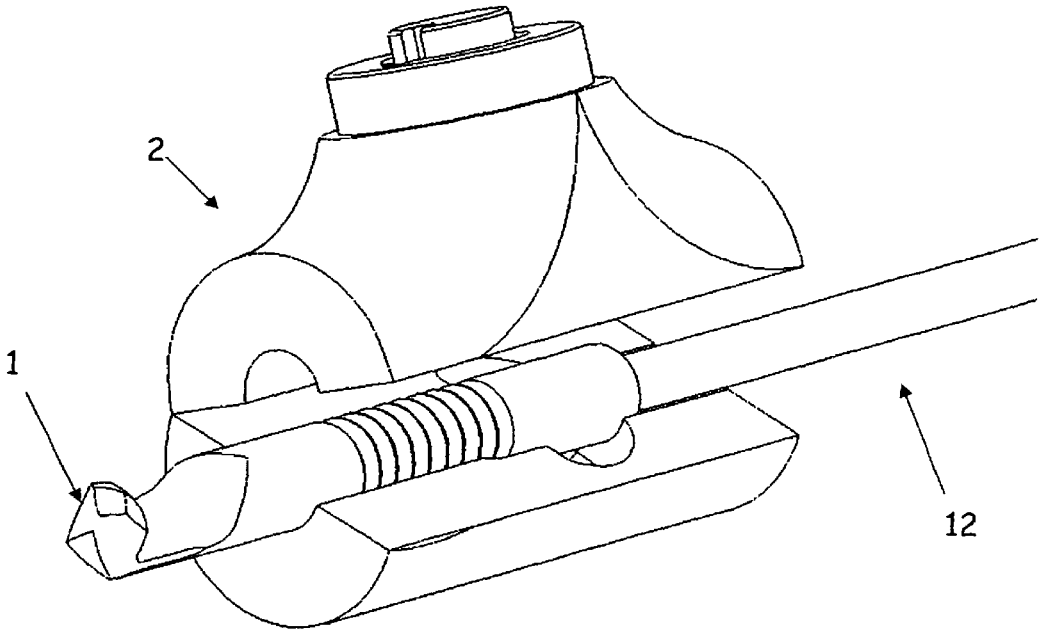
FIG. 13 is a perspective view of a housing having a clamshell design, which enables the security cable to be inserted through the housing the hooking mechanism is too large to fit through the transverse hole of the housing.

In general, the cable 12 is attached on its loop 11 at the proximal end to another object 13 such as a desk, beam, or pole by inserting the distal end through the loop 11 of the proximal end and tightening the cable 12 around the object 13. When securing multiple pieces of equipment 14, the housing assembly 2 would be temporarily removed from the cable 12 and the cable 12 would be passed through existing or added-on security fasteners 15 on the equipment to be secured 14. Added-on security fasteners 15 are well known in the art and can be glue-on, screw-on, or hook-on types. A type of added-on security fastener that uses the technology of the current invention is shown in FIG. 12.

The housing assembly 16 can then be locked back onto the cable 12 to be secured independently as in FIG. 2, or hooked into one last piece of equipment 17 as shown in FIG. 3. It can also be used to secure a single piece of equipment 17 like a laptop or projector as shown in FIG. 4. It can also be used to secure a piece of equipment like a toolbox 18 or equipment 17 (such as a CPU) from being opened in addition to securing it in place if the hook 1 is hooked simultaneously through aligned holes in the cover and case of the equipment to be secured (see FIG. 7).

Figure 8:
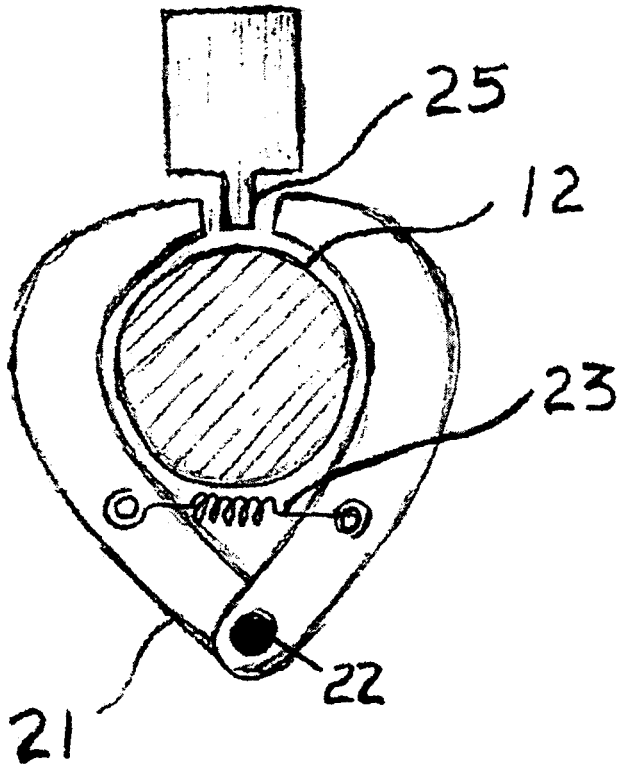
FIG. 8 is a cross-sectional end view of one possible clamping means inside the housing of the present invention to clamp onto the cable, biased in the clamped position with the spring. It also shows one possible design of the locking mechanism with the base of a lock cylinder in between the top of the clamp to separate and release the clamp when the key is turned. It is envisioned that the clamping means does not have to be biased in the clamped position, as it can be moved from clamped to unclamped by use of a locking mechanism that can leave it in either position.

It is recognized that many different methods of locking or clamping the housing assembly 2 onto the cable 12 are well known in the art, but one preferred method is illustrated in FIG. 8 by use of a gate or clamp 21 pivoting around a pivot point 22 and biased in the clamped or locked position by use of a spring 23 and unlocked or released from the clamped position by turning the key in locking mechanism 3 causing the base 25 of the locking mechanism 3 to separate the gate 21.

Figure 9:
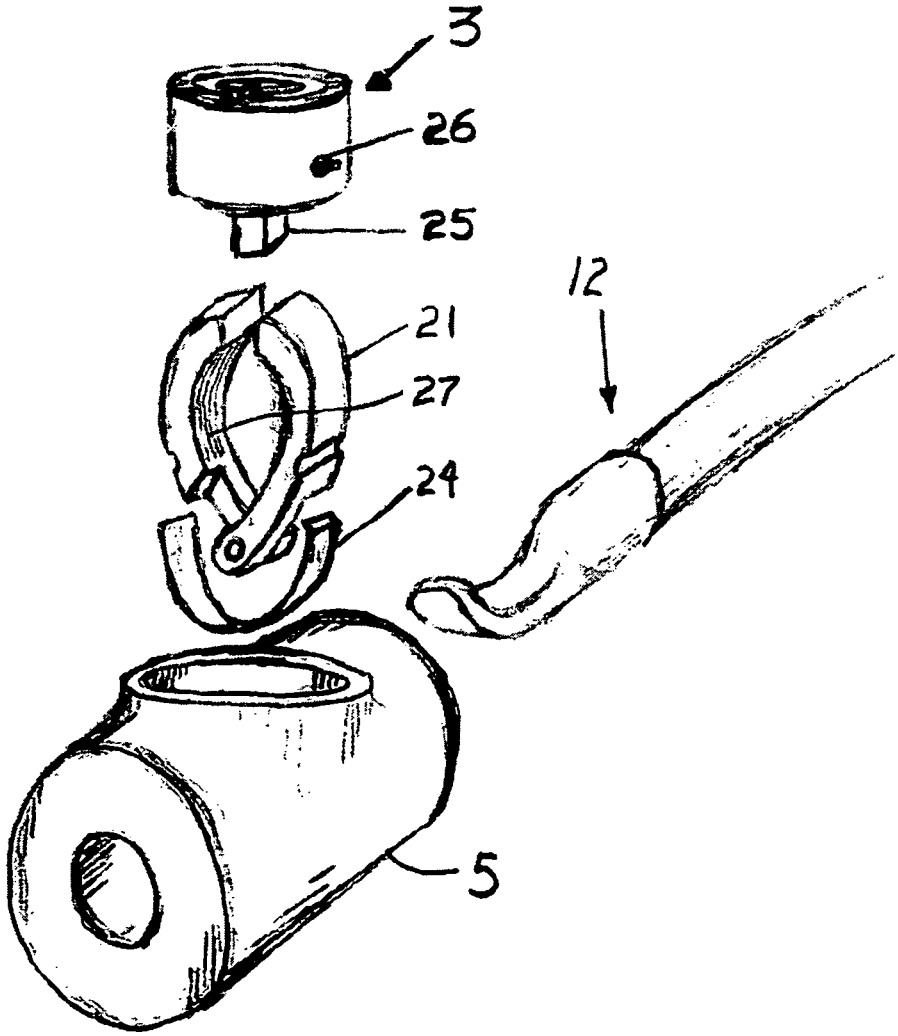
FIG. 9 is an exploded perspective view of the preferred embodiment of FIG. 1

FIG. 9 shows a preferred optional gate spring 24 similar in function to 23 and a spring-loaded mounting pin 26 used to assemble the locking mechanism 3 into the housing 5. Teeth 27 that point in one direction are located on the interior surface of the gate 21 to allow the housing assembly 2 to slide freely in one direction on the cable 12 and bite into the cable 12 in the other direction, requiring use of the key to unlock the gate 21 to move the housing assembly 2 in the other direction.

Figure 10A:
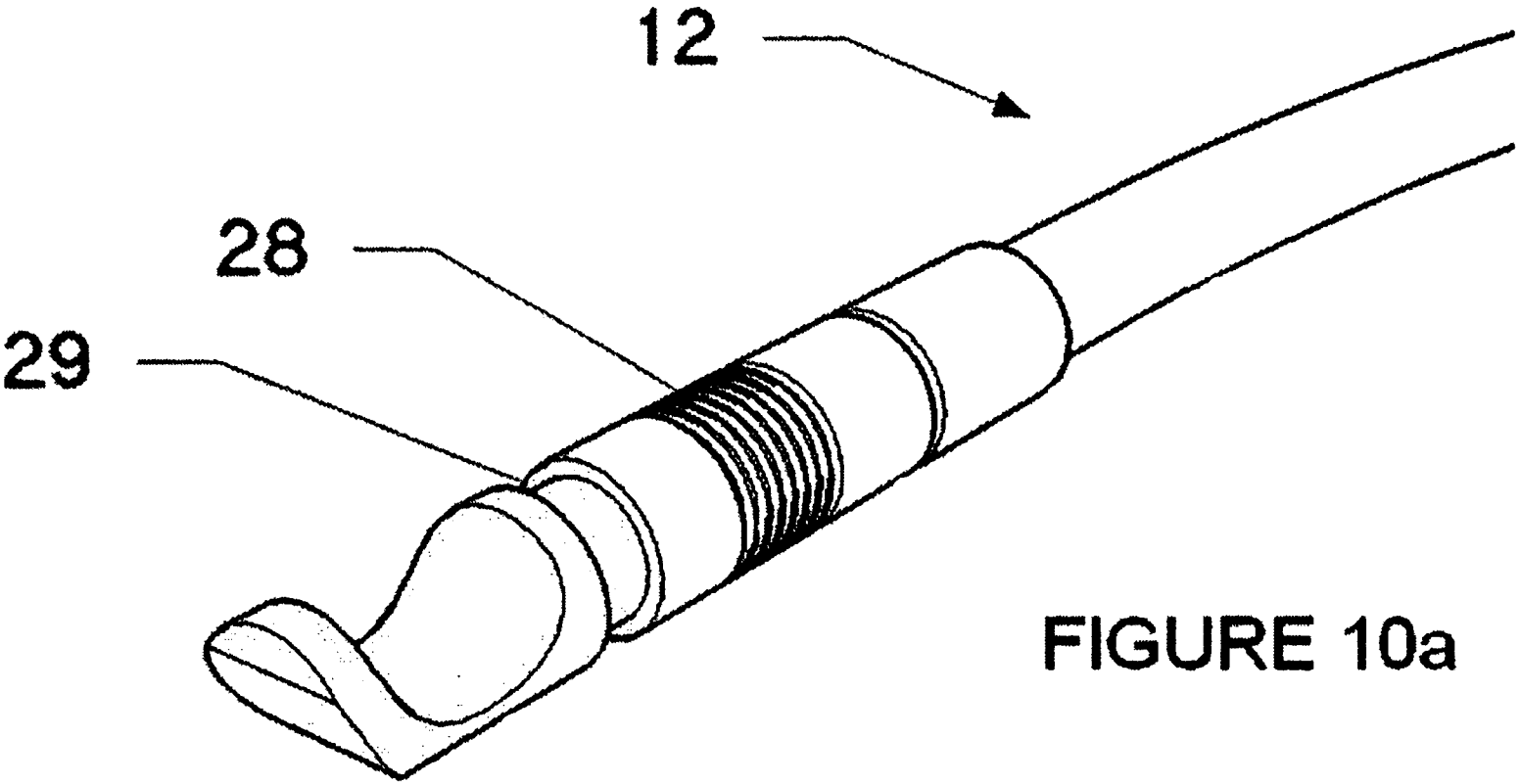
FIG. 10A is a perspective view of one preferred embodiment of the hook end of the cable, with grooves at specific locations to lock the housing onto multiple locations of the cable. Some of the grooves allow for ratcheting in only one direction without the key, the end groove will not allow movement in either direction without the key.
Figure 10B:
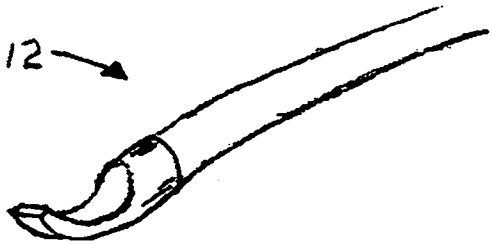
FIG. 10B is a perspective view of another preferred embodiment of the hook end of the cable, intended for use with a clamp that locks directly onto the cable jacket, normally a type of rubber. Depending on the design of the clamp teeth, the housing assembly of FIG. 1 would either slide only one direction without the key, or not slide at all without the key.
Figure 11A:
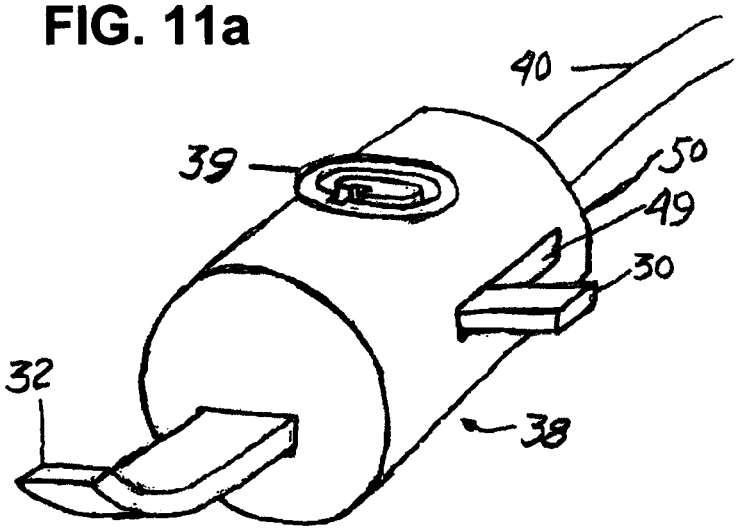
Figure 11B:
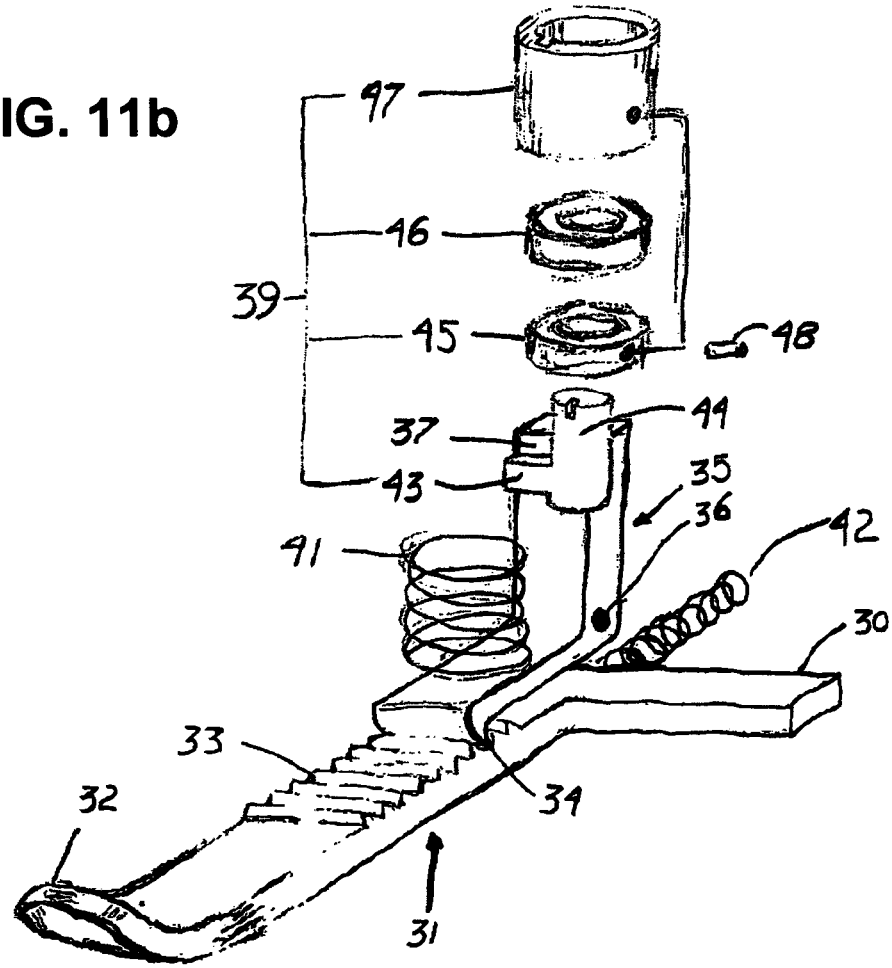
FIG. 11B is an exploded perspective view of the internal components of FIG. 11A. In this embodiment, the hook is not at the end of the cable, but integrated into the housing as a retractable hook. This embodiment would still be attached to a hole or slot in an external wall in the same method of FIGS. 6. The hook would be biased in the extended position by use of a spring, retracted into the housing by use of levers or gears, and would only move in the direction of retraction without unlocking the locking mechanism to allow extension.

In one preferred embodiment of the cable 12 (FIG. 10A), small grooves 28 cut into the distal end of the cable 12 that correspond in shape and size to the teeth 27 on the gate 21 allow the position of the housing assembly 2 relative to the cable 12 to be locked on in a tighter and more precise location if desired than locking onto the rubber jacket of the cable 12. A special, deeper groove 29 is also provided that doesn't allow the housing assembly 2 to move in either direction, and locks the housing assembly 2 onto the cable 12 in an exact position when used in the configuration of FIG. 2 so that it is more aesthetically pleasing because the hook 1 does not protrude outside the housing assembly 2 when it is not in use.

Figure 6A:
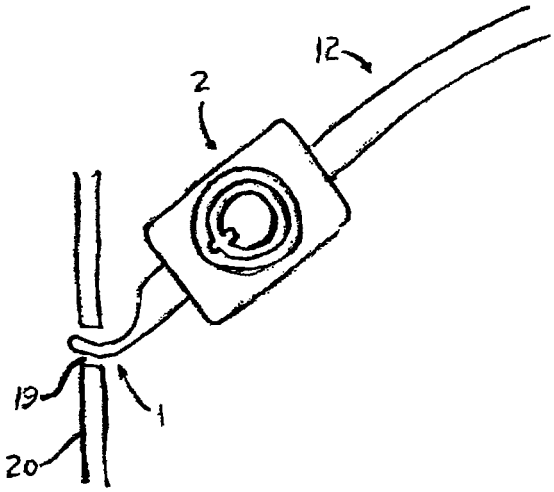
FIG. 6A is a side view of the hook in the first embodiment of the present invention as it enters the hole or slot in the external wall of the equipment at a second angle to the external wall.
Figure 6B:
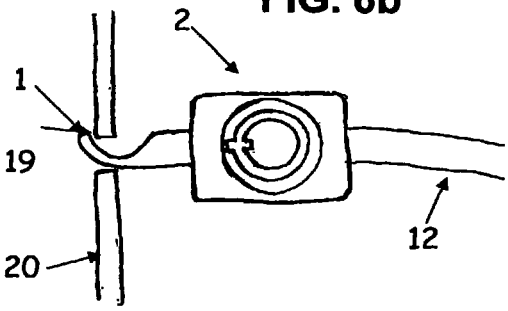
FIG. 6B is a side view of the hook in the first embodiment of the present invention after it has been hooked into the hole and moved to the first angle to the external wall, an angle in which the hook cannot be pulled out.

Another preferred embodiment of the current invention does not have a hook 32 at the end of the cable 40. Instead the hook 32 is integral with the housing assembly 38. The basic operating principle of the invention is the same and the hook assembly 31 is biased towards an extended position from the housing assembly 38 by use of a spring 42. This extended position allows for hooking of the hook 32 into the hole or slot 19 in the external wall 20 of the protected equipment. As shown in FIG. 6 the hook is moved from a second angle to a first angle, and then the hook assembly 31 is retracted into the housing assembly 38 by pulling the lever 30 which is part of the hook assembly 31 towards the back end 50 of the housing assembly 38 along the guide slot 49.

As the hook assembly 31 is retracted into the housing assembly 38, it is ratcheted into incrementally more retracted positions by the hook 34 on the locking bar 35 riding up the sloped side of each groove 33 on the hook assembly 31 and being pushed down into a locked position on the next groove 33 by the force of the spring 41. It continues to ratchet into each groove 33 incrementally until the housing assembly 38 is tight against the exterior wall 20 to prevent unhooking of the hook 32 from the protected equipment.

The illustrated locking mechanism, lock cylinder 39, is made up of the lock core 44 the lower washer 45 the upper washer 46 and the lock shell 47 and is all held together with a retaining pin 48 and is well known in the industry. It is envisioned that many types of locking mechanisms, such as keyed and combination lock cylinders can be used in the present embodiment.

Turning the key (not shown but as known in the art) in the lock cylinder 39, forces the base 43 of the lock core 44 to rotate into the upper side 37 of the locking bar 35, pivoting it around pivot point 36 and lifting hook 34 out of the grooves 33 and allowing the hook assembly 31 to extend back into its biased position and allowing the hook 32 to be removed from the protected equipment. The security cable 40 may be permanently or removably attached to the housing assembly 38 and attached at the other end to another object. The security cable 40 is also optional as the housing assembly 38 could be used simply to connect two external walls 20 together or keep a cover closed as shown in FIG. 7.

The hook assembly 31 can also be held in the retracted position by use of a padlock or security cable 52 instead of a locking mechanism by passing through a transverse aperture 53 of the security fastener 51 and not allowing removal of the security fastener 51 from the external wall. 20. Finally, in instances where a large hooking mechanism is required, a clamshell design may be used to construct the housing assembly 2 in the event the hooking mechanism is too large to fit through the transverse hole of said housing.

While several embodiments of the present invention have been illustrated by way of example, it is apparent that further embodiments could be developed within the spirit and scope of the present invention. However, it is to be expressly understood that such modifications and adaptations are within the spirit and scope of the present invention, as set forth in the following claims.

What is claimed is:

1. A locking system to secure portable equipment comprising:

a) a security cable comprising a proximal and a distal end;

b) a hooking mechanism immovably secured to said distal end of said security cable, disposed to be removably engaged to said portable equipment via a means for entry into an external wall of said portable equipment wherein said hooking mechanism is configured to remain secured when disposed at a first angle in relation to said external wall by directly hooking on to an edge of said external wall and configured to be disengaged when disposed at second angle in relation to said external wall;

c) a housing, removably attached in a longitudinal manner to said security cable, said housing forming a longitudinal aperture sized and configured to allow passage of said security cable and said hooking mechanism through the housing, said housing disposed on said security cable wherein said housing prevents displacement of said security cable from said first angle in relation to said external wall to said second angle in relation to said external wall;

d) wherein said proximal end of said security cable is coupled to an object other than said portable equipment; and wherein said housing is biased in a clamped position, the housing further comprising a clamp pivoting around a pivot point and biased in the clamped position by a spring;

and wherein a locking mechanism must be unlocked to allow said housing to move freely on the security cable.

2. The locking system to secure portable equipment of claim 1 further comprising a means for removably attaching said proximal end of said security cable to said object.

3. The locking system to secure portable equipment of claim 1 further comprising a means for removably attaching said proximal end of said security cable to said substantially secure object.

4. The locking system to secure portable equipment of claim 1 wherein said means for entry into an external wall of said portable equipment is selected from the group consisting of an aperture, a cutaway, a channel or a slot, permanently disposed within said portable equipment.

5. The locking system of claim 1 wherein said housing is movably attached to said security cable and restrained from movement by a locking mechanism.

6. The locking system of claim 5 wherein said locking mechanism is selected from the group consisting of a keyed locking mechanism, a detent locking mechanism and a combination locking mechanism.

7. The locking system of claim 5 wherein said housing is movably attached to said security cable by a flexible means selected from the group comprising gates, grooves, ratchets and teeth, which allows for movement of said housing in one direction along said security cable, relative to said hooking mechanism and restrain movement in the opposite direction along said security cable.

8. The locking system of claim 5 wherein said housing cannot be removed from said security cable without unlocking said locking mechanism.

9. The locking system of claim 1 wherein said housing is removably attached to said security cable.

10. The locking system of claim 1 wherein said portable equipment is a computer.

11. A locking system to secure portable equipment, comprising:

a) a hook coupled to a housing, the hook connectable to an opening in an external wall of said portable equipment to be secured when said hook is oriented at a first angle in relation to said external wall by directly hooking to an edge of said external wall, and wherein said hook uncouples when oriented at a second angle in relation to said external wall;

b) a means of incrementally sliding said hook into said housing until said housing is substantially juxtaposed to said external wall, wherein preventing said hook from being oriented at said second angle in relation to said external wall to prevent removal;

c) the hook being biased toward an extended position from said housing by a spring positioned between a rear of said hook and a surface of said housing;

d) wherein said means of incrementally sliding said hook into said housing comprises a plurality of grooves on a top surface, each of the grooves having a sloped side and a flat side, and an extension of said hook external to said housing constructed and arranged to allow manual retraction of said hook;

e) a locking bar constructed to engage with one of the plurality of grooves, said locking bar capable of riding up said sloped side of one of said plurality of grooves as said hook is incrementally slid into said housing, said locking bar being pushed down into a locked position against said next of the plurality of grooves by a downward force of a second spring, said locking bar being raised upwardly against said force of said second spring when a locking mechanism is moved to an unlocked position;

f) an extension of said hook external to said housing constructed and arranged to allow manual retraction of said hook; and, g) a security cable comprising a first end coupled to said housing and a second end coupled to an object other than the portable equipment.

12. The locking system to secure portable equipment of claim 11 wherein said opening in said external wall of said portable equipment is selected from the group consisting of an aperture, a cutaway, a channel or a slot, permanently disposed within said portable equipment.

13. The locking system of claim 11 wherein said housing is movably attached to said security cable by a means comprising a locking mechanism.

14. The locking system of claim 13 wherein said means comprising a locking mechanism is selected from the group consisting of a keyed locking mechanism, a detent locking mechanism and a combination locking mechanism.

15. The locking system of claim 11 wherein said hook is freely retractable into said housing when a locking mechanism is engaged and requires the locking mechanism to be disengaged to move in the other direction.

16. The locking system of claim 11 wherein said housing is removably attached to said security cable.

17. The locking system of claim 11 wherein said housing cannot be removed from said security cable without unlocking a lock said locking mechanism.

18. The locking system of claim 11 wherein said portable equipment is a computer.

19. A locking system to secure portable equipment comprising:

a) a security cable comprising a proximal and a distal end;

b) a hooking mechanism immovably secured to said distal end of said security cable, disposed to be removably engaged to said portable equipment via a means for entry into an external wall of said portable equipment wherein said hooking mechanism is configured to remain secured when disposed at a first angle in relation to said external wall by directly hooking on to an edge of said external wall and configured to be disengaged when disposed at second angle in relation to said external wall;

c) a housing, removably attached in a longitudinal manner to said security cable, said housing forming a longitudinal aperture sized and configured to allow passage of said security cable and said hooking mechanism through the housing, said housing disposed on said security cable wherein said housing prevents displacement of said security cable from said first angle in relation to said external wall to said second angle in relation to said external wall;

d) wherein said proximal end of said security cable is coupled to an object other than said portable equipment; and wherein said hooking mechanism further comprises a set of grooves, the housing further comprising a clamp pivoting around a pivot point and biased in a clamped position by a spring; wherein said clamp is biased in said clamped position onto an individual of said set of grooves to maintain specific positions and cannot be moved in either direction without unlocking a locking mechanism.

* * * * *